US005588404A

United States Patent [19]

Lichti et al.

[11] Patent Number: 5,588,404

[45] Date of Patent: Dec. 31, 1996

[54] VARIABLE CAM PHASER AND METHOD OF ASSEMBLY

[75] Inventors: Thomas H. Lichti, Rochester; Daniel R. Cuatt; Mark A. Shost, both of Henrietta; Ronald A. Waydelis, Rochester; Michael J. Fox, Stafford, all of N.Y.

[73] Assignee: General Motors Corporation, Detroit, Mich.

[21] Appl. No.: 353,776

[22] Filed: Dec. 12, 1994

[51] Int. Cl.[6] ..... F01L 1/344

[52] U.S. Cl. ..... 123/90.17; 123/90.31; 74/568 R; 29/428; 29/888.01; 464/2

[58] Field of Search ..... 123/90.15, 90.17, 123/90.27, 90.31; 464/1, 2, 160; 74/567, 568 R; 29/888.01, 428

[56] References Cited

U.S. PATENT DOCUMENTS

| | | | |
|---|---|---|---|
| 4,811,698 | 3/1989 | Akasaka et al. | 123/90.17 |
| 4,960,084 | 10/1990 | Akasaka et al. | 123/90.17 |
| 4,996,955 | 3/1991 | Akasaka et al. | 123/90.17 |
| 5,040,499 | 8/1991 | Akasaka et al. | 123/90.17 |
| 5,058,539 | 10/1991 | Saito et al. | 123/90.17 |
| 5,119,691 | 6/1992 | Lichti et al. | 74/568 R |
| 5,163,872 | 11/1992 | Niemiec et al. | 464/2 |
| 5,184,401 | 2/1993 | Hirose et al. | 123/90.27 |

FOREIGN PATENT DOCUMENTS

| | | |
|---|---|---|
| 4225093 | 2/1993 | Germany . |
| 4218081 | 12/1993 | Germany . |

*Primary Examiner*—Weilun Lo

[57] ABSTRACT

A variable cam phaser has drive and driven members connected by helical splines of an annular phase control piston and a lash control piston, axial motion of which varies the angular phase relation between the drive and driven members. A single wave spring received in a groove in one of the pistons biases them apart to take up lash in the splines. A return spring biases the phase control piston to an initial phase setting. Pre-timing of the members is provided for by a driven (or drive) member comprising two components, a hub flange that supports the other member and a splined hub carried by and initially rotatable on a tubular protrusion of the hub flange. After assembly of the phasing mechanism, the hub is rotated on the hub flange to pre-time the initial phasing of the members. An end of the tubular protrusion is then deformed into a flange engaging an annular shoulder on the hub to lock the hub and hub flange members together and maintain the pre-timing. An annular cover is then installed and retained by a retaining ring to close a hydraulic pressure chamber and help support the members. Upon assembly to a camshaft, a center bolt clamps the cover, hub and hub flange to the camshaft and relieves the locking means from operational torque loads.

18 Claims, 3 Drawing Sheets

VARIABLE CAM PHASER AND METHOD OF ASSEMBLY

TECHNICAL FIELD

This invention relates to phase adjusting drives and more particularly to variable cam phasing devices for varying the timing of valve actuation by an engine camshaft.

BACKGROUND

It is known in the art relating to engine valve gear to provide various means for varying valve timing as desired for the control of engine performance and efficiency. Among the various types of variable valve timing devices employed have been camshaft phasing devices, or cam phasers, often in the form of drive pulleys and the like, incorporating phase changing means for varying the phase between a rotatable input drive member such as a gear, pulley or sprocket, and a coaxial rotatable output driven member such as a camshaft. Among the pertinent prior art are mechanisms having helically splined pistons which are hydraulically actuated against a spring to vary the phasing of outwardly and inwardly engaged drive and driven members. Such arrangements are shown for example in U.S. Pat. No. 5,163,872 issued Nov. 17, 1992, and assigned to the assignee of the present invention. A list of additional prior art references is included in that patent.

SUMMARY OF THE INVENTION

The present invention provides a variable cam phaser similar in some respects to splined piston cam phasers shown in the prior art but including other features which improve the manufacture and compactness of such devices and their assembly to an engine camshaft.

A feature of the invention is that a driven member attached to the camshaft comprises a hub assembly made up of a hub flange rotatably supporting a drive pulley or the like and a separate tubular hub carrying external splines. During assembly, the splined tubular hub is fitted over a tubular portion of the hub flange on which it is free to rotate. This allows adjustment of the hub on the hub flange for pre-timing the hub flange to the drive pulley, or other drive member, after assembly of the splined cam phaser elements. Thereafter, the hub and hub flange are locked together by staking a portion of the hub flange against a shoulder of the hub, thus maintaining the set timing until installation of the cam phaser in an engine. Manufacture and assembly of the splined components are significantly simplified by this arrangement since it is not necessary to provide a specified orientation of the internal or external splines of the individual elements for timing purposes.

Another feature of the invention is that a single cylindrical wave type spring is mounted in an axially concentric groove of at least one of the piston members for biasing the second piston member away from the first to take up lash in the splines. The arrangement simplifies manufacture and assembly and reduces the number of parts and package size as compared to the multiple biasing spring components of prior arrangements such as that shown in U.S. Pat. No. 5,163,872.

Another feature of the invention is that the driving member sprocket, pulley or gear is rotatably supported on the hub flange and is additionally supported at an opposite end by an annular cover which engages both the hub and a tubular extension of the drive member. Upon assembly, a single centrally located bolt fastener engages the cover and locks it together with the hub and the hub flange to an associated camshaft to maintain these elements in fixed relation. Thereafter, the staking of the hub to the hub flange is no longer required to carry torsional loads, such as those occurring during operation of the device in driving the camshaft in an engine.

These and other features and advantages of the invention will be more fully understood from the following description of certain exemplary embodiments of the invention taken together with the accompanying drawings.

BRIEF DRAWING DESCRIPTION

DETAILED DESCRIPTION

Figure 1:
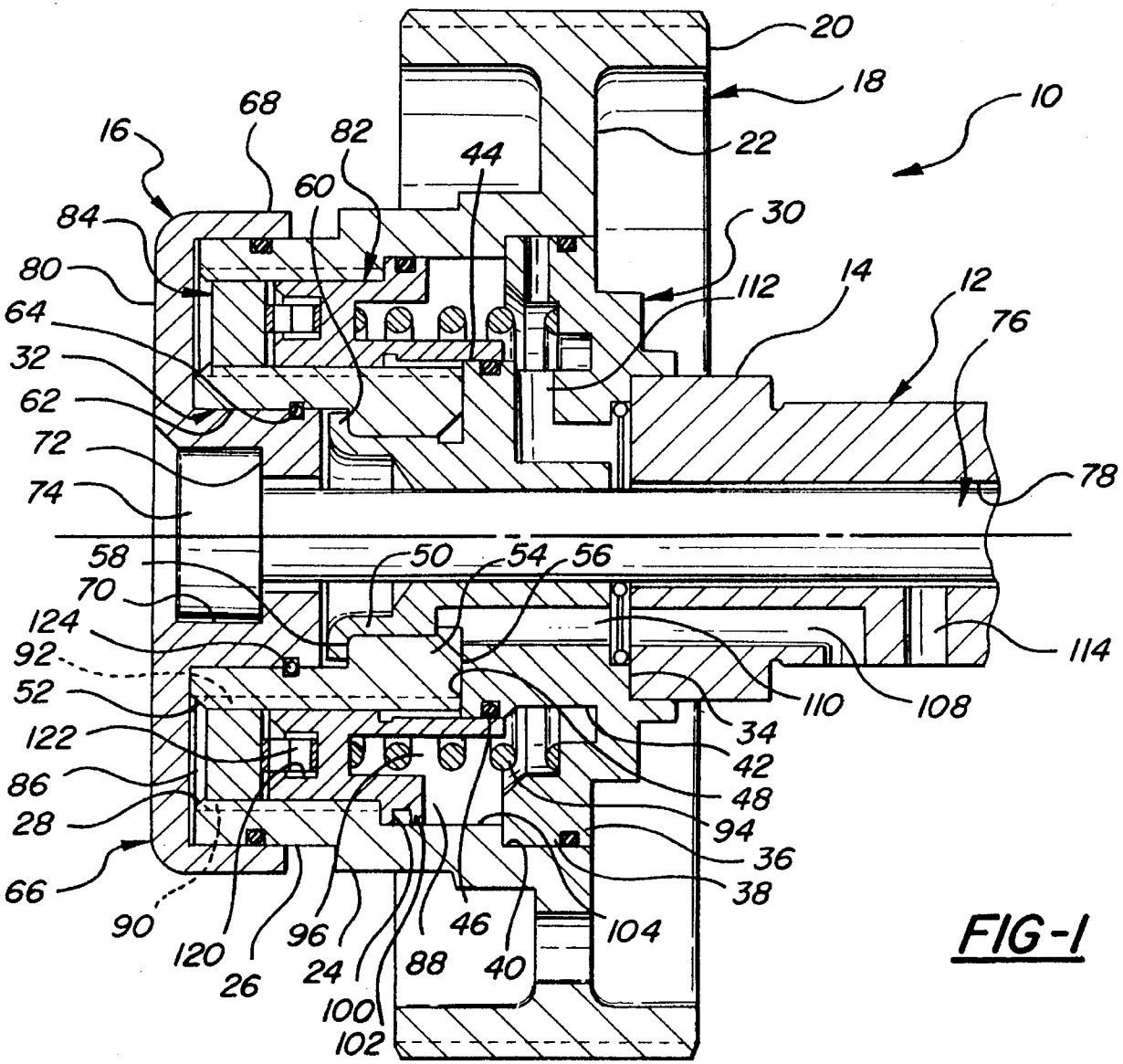
FIG. 1 is an axial cross-sectional view of a variable cam phaser according to the invention shown attached to an associated camshaft.

Referring now to the drawings in detail, numeral 10 generally indicates a portion of the valve gear of an internal combustion engine including a camshaft 12 conventionally carrying a plurality of valve actuating cams, not shown, and mounted for rotation in the cylinder head or other portion of an engine, not shown. Camshaft 12 includes at one end an enlarged cylindrical journal 14, which may be a bearing journal, on the end of which is fixedly mounted a variable cam phaser 16 formed according to the invention.

Cam phaser 16 includes an outer drive member in the form of a pulley 18 (although a chain sprocket, gear or other suitable drive device could equally well be used). The pulley 18 includes an outer rim 20, adapted to be driven by a toothed timing belt, not shown. The rim 20 is connected by a web 22 with a tubular portion 24 extending axially to one side of the web and having at an outer end a cylindrical external bearing surface 26. Within the portion 24 and extending from the outer end adjacent bearing surface 26, are internal right hand helical splines 28.

Pulley 18 is supported for relative rotation upon a coaxial driven hub assembly comprising an assembly of a hub flange 30 and a hub 32. The hub flange includes an end having a circular recess 34 in which the end of the camshaft journal 14 is received. A flange 36 extends outwardly from the recess 34 and terminates outwardly in an enlarged cylindrical journal 38 that slidably engages an internal bearing surface 40 of the hub 24. Adjacent to the flange 36 and opening away from the camshaft 12, the hub flange 30 includes a recess 42 adjacent an external guiding surface 44 containing a piston seal ring 46. Adjacent the guiding surface 44, a shoulder 48 extends inwardly to a smaller diameter tubular portion 50 on which the hub 32 is supported.

Hub 32 comprises a tubular body provided, on an outer diameter, with external left hand helical splines 52. On its inner diameter, hub 32 includes a raised portion 54 carried by tubular portion 50, an end face 56 engaging the shoulder 48 and an annular shoulder 58 that is engaged by an outwardly flared flange 60 formed by a thin wall end of the tubular portion 50 of the hub flange. Further outward, in the direction away from the camshaft, the hub 32 inner diameter forms a slightly enlarged internal locating surface 62 having a retaining ring groove 64 toward its inner end.

An annular cover 66 having a central opening and a generally U-shaped annular cross-section is mounted on the outer ends of the hub 32 and tubular portion 24. The cover includes an outer wall 68 with an inner surface engaging the bearing surface 26 of the tubular portion 24 and an inner wall 70 having an outer surface engaging the internal locating surface 62 of the hub. An inward extension of the inner wall forms a shoulder 72 against which is clamped the head 74 of a central fastener in the form of an attaching bolt 76. The bolt extends through openings in the cover 66 and the hub flange 30 into a hollow center 78 of the camshaft 12 wherein it is threadably engaged in a manner not shown. An annular end wall 80 of the cover extends between the outer and inner walls 68, 70 and encloses an annular space within the cam phaser. Within this space are located a first annular phase control piston 82 and a second annular lash control piston 84.

The first piston 82 divides the annular space into an annular pressure chamber 86 adjacent the cover 66 and an annular return chamber 88 between the flange 36 and the piston 82. Piston 82 includes a ring of external right hand helical splines 90 engaging the internal splines 28 within the tubular portion 24 of the pulley 18. Additionally, there is a ring of internal left hand helical splines 92 that engage the external helical splines 52 of the hub 32. Accordingly, axial motion of the piston 82 causes a change in the angular orientation or phase relation between the pulley 18 and the hub 32, as well as the associated camshaft 12 to which the hub is attached.

A large helical coil compression spring 94 is seated against the flange 36 of the hub flange and is received in a recess 96 of the piston 82 for biasing the piston in a direction toward the annular cover 66, tending to return the camshaft to a predetermined position, such as a retarded or advanced position for valve actuation. The spring 94 lies within the return chamber 88 formed on the camshaft side of the piston. A piston seal ring 100 seated in a groove in a guiding surface 102 of the piston 82 engages a cylinder surface 104 within the tubular portion 24 of the pulley 18. Piston seal ring 100 and piston seal ring 46 in the guiding surface 44 of the hub flange, which engages a cylindrical surface 106 of the piston, limit the leakage of oil between the pressure chamber 86 and the return chamber 88.

To actuate the piston in an opposite direction, against the bias of spring 94, for example, to advance the camshaft timing, pressurized engine oil, or other hydraulic fluid, is provided through passages 108 in the camshaft and 110 in the hub flange to the pressure chamber 86. Fluid leaking into the return chamber 88 may be discharged through passages 112 in the hub flange which communicate with drain passages 114 in the camshaft. Alternatively, passages 112 could be connected with a return pressure oil supply for forcing the piston 82 in a return direction. Suitable seals are provided to prevent the leakage of pressure and drain oil from the interior of the cam phaser to external surfaces of the pulley 18.

The annular lash control piston 84 is located in the pressure chamber 86 between the piston 82 and the cover 66. This piston includes external and internal helical splines 116, 118 like those of piston 82 and also engaging the corresponding splines 28, 52 of the pulley and hub respectively. The splines of the two pistons are preferably formed with machined end surfaces of the pistons in engagement with one another so that the helices of the splines are continuous when the pistons are engaged. An annular groove 120 in the phase control piston 82, opening toward the facing surface of the lash control piston 84, receives a cylindrical compression spring, preferably in the form of a wave spring 122 best shown in FIG. 2. Spring 122 urges the lash control piston 84 away from the phase control piston 82 and takes up the lash in the splines between the associated pulley and hub. In this lash control action, the pistons 82, 84 function in the same manner as known split gears used for lash control in gear drives.

Figure 2:
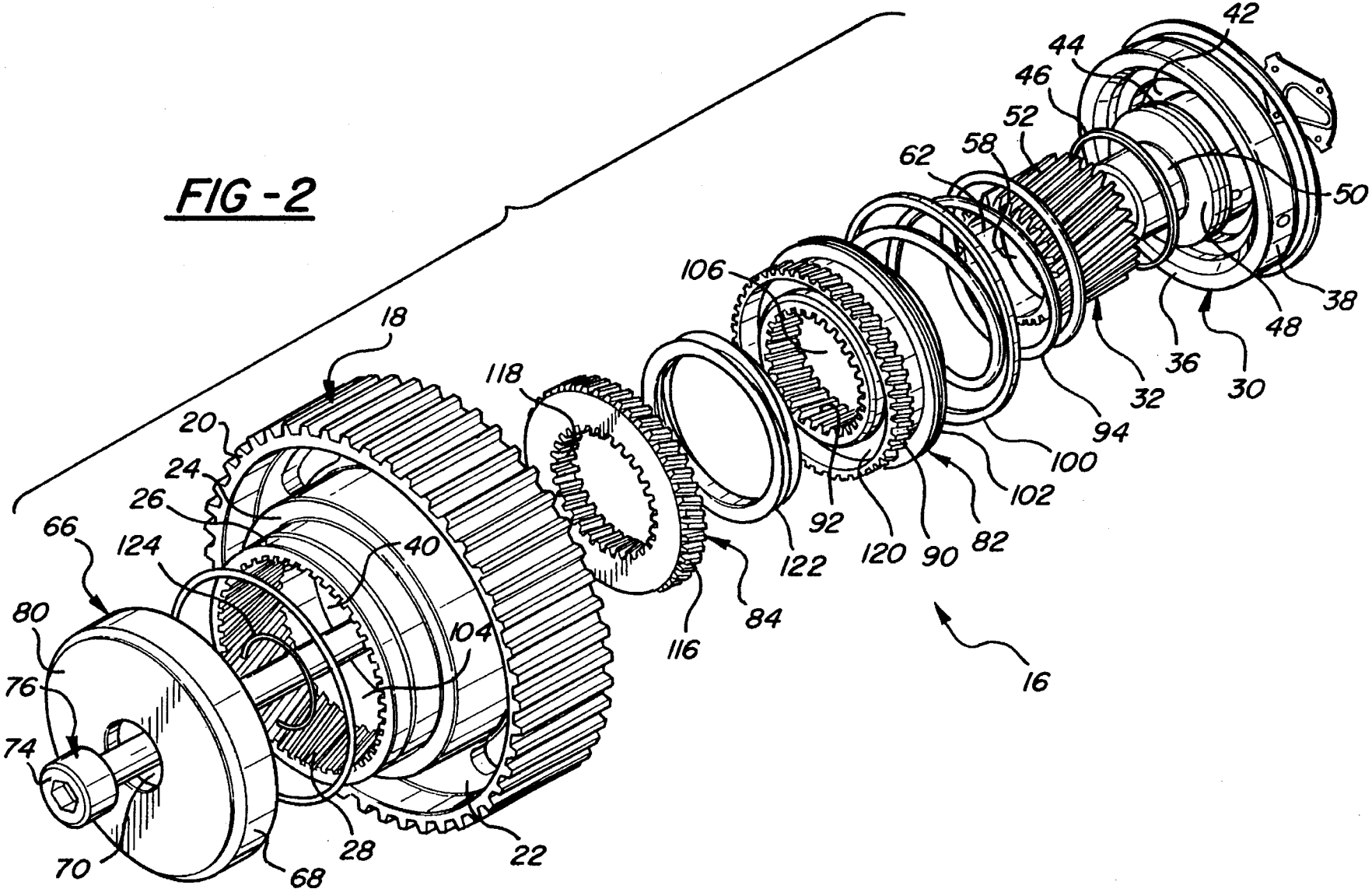
FIG. 2 is an exploded pictorial view of the cam phaser of FIG. 1.
Figure 3:
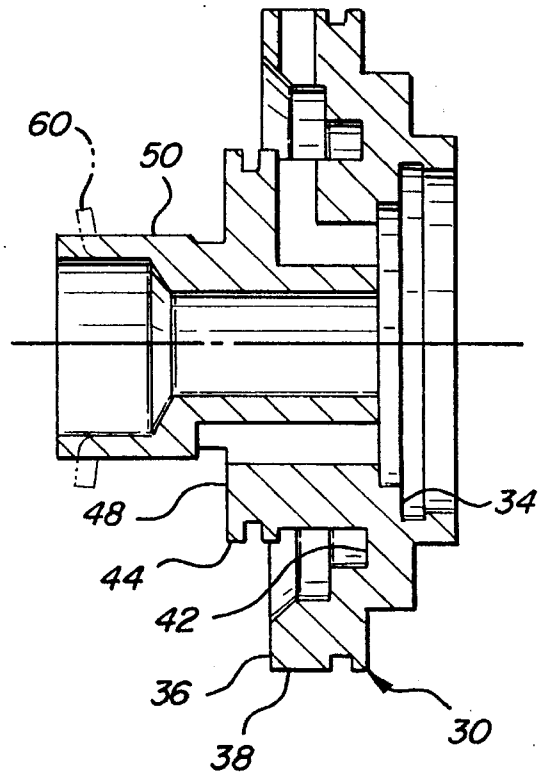
FIG. 3 is an axial cross-sectional view of a hub flange for the cam phaser of FIG. 1 prior to its assembly with the associated hub.

Prior to assembly of the cam phaser of FIGS. 1–3, the hub flange 30 has its tubular portion 50 extending axially as shown by solid lines in FIG. 3. This component is then assembled together with the hub 32, pistons 82, 84 and pulley 18. The hub 32 is not then fixed to the hub flange, but is rotatable on the tubular portion 50, so that the pulley 18 with the splined pistons and hub may be rotated relative to the hub flange 30 in order to properly time the pulley to the hub flange with the compression spring 94 fully extended. The outer end of the tubular portion 50 is then deformed, such as by staking or rolling, to form the flange 60 shown in FIG. 1 and by dashed lines in FIG. 3. Flange 60 engages shoulder 58 of the hub, locking the components in their desired orientations. The cover 66 may then be installed and is retained by a retaining ring 124 until assembly of the unit to an engine camshaft.

Thereafter, the pre-timed mechanism is installed on a camshaft 12 as in FIG. 1. A conventional pin, not shown, may be used to orient the hub flange 30 to the camshaft for proper timing. A bolt 76 is threaded through the openings into the camshaft and tightened so as to lock the cover, hub, hub flange and camshaft elements into fixed relation. This manner of assembly permits the manufacture and assembly of the splined components to be carried out without regard to any requirement for orientation or fixed relation of the internal and external splines, other than the splines on the two pistons which are formed together. This significantly simplifies the manufacturing and assembly process and allows timing of the elements to be conducted only after assembly of the mechanism components in the manner previously described.

Figure 4:
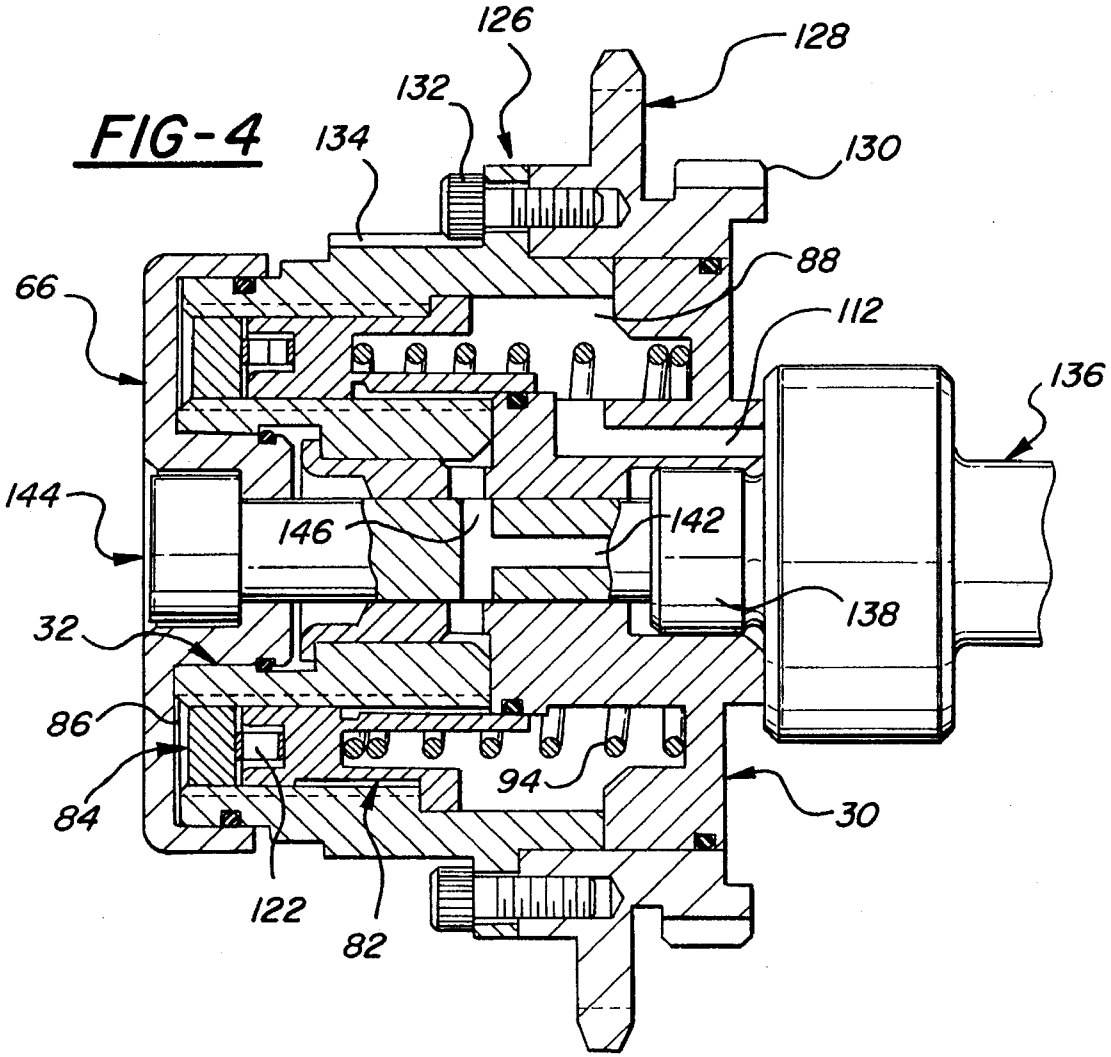
FIG. 4 is a cross-sectional view similar to FIG. 1 but showing an alternative embodiment of variable cam phaser according to the invention.

In FIG. 4, an alternative embodiment of cam phaser 126 is illustrated as an example of various possible alternative arrangements which may be made. Cam phaser 126 is basically similar to cam phaser 16 of FIGS. 1–3 so that similar components are identified by like numerals.

One difference is that cam phaser 126 is formed with a chain sprocket 128 rather than the belt pulley 18 of FIGS. 1–3. Also the sprocket member includes an adjacent gear section 130 for driving an associated component of the engine in which it is to be installed. The sprocket and gear portions are formed as an integral ring which is secured by screws 132 to a cylindrical portion 134 corresponding to the tubular portion 24 of cam phaser 16. This construction allows the sprocket and gear portions to be made of an alloy gear material which is not needed for the associated cylindrical portion.

Cam phaser 126 also has a greater axial length than phaser 16 having increased lengths of the piston 82, hub 32, and hub flange 30 in order to allow for extended lengths of the splines and greater travel of the piston.

Another difference in cam phaser 126 is that a small cylindrical protrusion 138 on the camshaft 136 centers the phaser on the camshaft. Pressure oil is delivered from a central passage, not shown, within the camshaft to a drilled central passage 142 within the bolt 144 which intersects a cross passage 146 connecting with the high pressure chamber 86. The hub flange passages 112 connect with an associated drain or pressure supply passage, not shown, within the camshaft as before.

If external oil control means are used to provide controlled pressure oil to the return chamber 88 in the cam phaser, the piston may be actuated in both directions by pressure oil. With such known supply systems, not shown, the return spring 94 will function only to return the cam phaser to its initial position when pressure in the pressure chamber is released.

While the invention has been described by reference to certain specific embodiments, it should be understood that numerous changes could be made within the spirit and scope of the inventive concepts described. Accordingly it is intended that the invention not be limited to the disclosed embodiments, but that it have the full scope permitted by the language of the following claims.

The embodiments of the invention in which an exclusive property or privilege is claimed are defined as follows:

1. A variable cam phaser including coaxial drive and driven members drivingly connected by a first annular phase control piston having inner and outer helical splines of varying lead engaging respective mating splines of said members, the piston being axially movable to vary the phase relation between said drive and driven members, force means operative to act against the piston for moving the piston axially, and the improvement comprising:

one of said drive and driven members including a hub provided with outer helical splines as part of said mating splines and a hub flange supporting the hub; and locking means operative in an unlocked position to allow angular adjustment of said hub on said hub flange after assembly with the other of said drive and driven members to provide a selected angular orientation of said drive and driven members, said locking means being movable to a locked position wherein it is operative to maintain said angular orientation until installation of the cam phaser on a camshaft.

2. The invention as in claim 1 wherein said locking means comprises a tubular protrusion of said hub flange extending through an axial opening of said hub including a shoulder, said protrusion having an end portion deformable into contact with said shoulder for locking said hub and hub flange together.

3. The invention as in claim 2 and further comprising:

a second annular lash control piston adjacent the first piston and having inner and outer helical splines of varying lead engaging said respective mating splines of said drive and driven members, said first and second pistons having opposed annular end faces;

means defining an annular groove concentric with and recessed into at least one of said annular end faces and opening toward the other end face; and a generally cylindrical axial compression spring seated in said annular groove and acting against both of said pistons for biasing them apart to take up lash between the pistons and the drive and driven members.

4. The invention as in claim 3 wherein said spring is a wave spring.

5. The invention as in claim 4 wherein said force means include hydraulic means capable of applying fluid pressure against said first piston for moving it axially in at least one direction.

6. The invention as in claim 5 wherein said force means further include a compression spring biasing said first piston axially opposite to said one direction.

7. A variable cam phaser including coaxial drive and driven members drivingly connected by a first annular phase control piston having inner and outer helical splines of varying lead engaging respective mating splines of said members, the piston being axially movable to vary the phase relation between said drive and driven members, force means operative to act against the piston for moving the piston axially, and the improvement comprising:

said driven member including a hub provided with outer helical splines as part of said mating splines and a hub flange including a tubular portion supporting the hub and a flange portion near one end of the cam phaser and extending radially beyond said hub outer splines into supporting engagement with said drive member;

an annular cover on an opposite end of the cam phaser from said one end and radially supporting the drive member on said hub at said opposite end; and a central fastener extending through said cover and said driven member for clamping said cover, said hub and said hub flange together in fixed relation with an associated camshaft.

8. The invention as in claim 7 and further comprising:

locking means operative in an unlocked position to allow angular adjustment of said hub on said hub flange after their assembly with said drive member to provide a selected angular orientation of said drive and driven members, said locking means being movable to a locked position wherein it is operative to maintain said angular orientation until installation of the cam phaser on a camshaft.

9. The invention as in claim 8 wherein said locking means comprises a tubular protrusion of said hub flange extending through an axial opening adjacent a shoulder of said hub, said protrusion having an end portion deformable into contact with said shoulder for locking said hub and hub flange together.

10. The invention as in claim 7 and further comprising:

retaining means on one of said cover and said hub and engaging the other of said cover and said hub upon assembly for retaining the cover on the drive and driven members pending securing of the cam phaser to a camshaft.

11. The invention as in claim 7 and further comprising:

a second annular lash control piston adjacent the first piston and having inner and outer helical splines of varying lead engaging said respective mating splines of said drive and driven members, said first and second pistons having opposed annular end faces;

means defining an annular groove concentric with and recessed into at least one of said annular end faces and opening toward the other end face; and a generally cylindrical axial compression spring seated in said annular groove and acting against both of said pistons for biasing them apart to take up lash between the pistons and the drive and driven members.

12. The invention as in claim 11 wherein said spring is a wave spring.

13. The invention as in claim 12 wherein said force means include hydraulic means capable of applying fluid pressure against said first piston for moving it axially in at least one direction.

14. The invention as in claim 13 wherein said force means further include a compression spring biasing said first piston axially opposite to said one direction.

15. A method for assembling a pre-timed cam phaser for an engine camshaft, said method comprising:

providing drive and driven members engagable with phase control means axially movable to vary the angular phase relation between said members, one of said members comprising two components having locking means movable to a locked position for locking said components in fixed angular relation, one of said components being supported and initially rotatable upon the other component, said one of said components being engagable with said phase control means and the other of said components being engagable with an external member;

assembling said drive and driven members together with said phase control means held in an initial position wherein said one component of said one member is rotationally related with the other of said members to form a mechanism of temporarily fixed angular relation;

rotating said other component relative to said one component to establish a pre-timed initial orientation of said other component with said other member; and moving said locking means to said locked position to prevent further rotation of said one component relative to the other component;

whereby said pre-timed initial orientation of said other component relative to said other member is maintained while said phase control means remains in said initial position.

16. The method of claim 18 wherein said step of moving said locking means comprises deforming a tubular end of said other component against a shoulder of said one component.

17. The method of claim 16 wherein said act of deforming comprises staking.

18. The method of claim 16 wherein said act of deforming comprises forming a flange on said tubular end and bending said flange into engagement with an annular shoulder of said one component.

* * * * *